US007882586B2

(12) United States Patent
de la Chevrotière

(10) Patent No.: US 7,882,586 B2
(45) Date of Patent: Feb. 8, 2011

(54) MOMENT-RESISTING JOINT AND SYSTEM

(76) Inventor: Alexandre de la Chevrotière, 5423, St-Dominique, Montreal, Quebec (CA) H2T 1V5

( * ) Notice: Subject to any disclaimer, the term of this patent is extended or adjusted under 35 U.S.C. 154(b) by 0 days.

(21) Appl. No.: 12/495,084

(22) Filed: Jun. 30, 2009

(65) Prior Publication Data

US 2009/0266024 A1 Oct. 29, 2009

(51) Int. Cl.
*E01D 19/00* (2006.01)
*E01D 6/00* (2006.01)

(52) U.S. Cl. ..... 14/14; 14/3

(58) Field of Classification Search ..... 14/3, 14/14; 403/171–175, 217, 218, 70, 71
See application file for complete search history.

(56) References Cited

U.S. PATENT DOCUMENTS

| | | | |
|---|---|---|---|
| 187,513 | A | 2/1877 | Colby |
| 693,259 | A | 2/1902 | Gilbert |
| 1,264,227 | A | 4/1918 | Uhl |
| 1,500,235 | A | 7/1924 | Clark |
| 1,554,224 | A | 9/1925 | McGrath |
| 1,792,489 | A | 2/1931 | Gilmore |
| 2,839,320 | A | 6/1958 | Hill |
| 3,562,994 | A | 2/1971 | Von Linsowe |
| 3,834,549 | A | 9/1974 | Burg et al. |
| 3,901,613 | A | 8/1975 | Andersson |
| 4,007,507 | A | 2/1977 | Hansen |
| 4,104,843 | A | 8/1978 | Gilb |
| 4,120,065 | A | 10/1978 | Sivachenko et al. |
| 4,129,975 | A | 12/1978 | Gabriel |
| 4,136,985 | A | 1/1979 | Taul |
| 4,155,150 | A | 5/1979 | Oehmsen et al. |
| 4,161,769 | A | 7/1979 | Elliott |
| 4,822,199 | A | 4/1989 | Nehls |
| 4,912,795 | A | 4/1990 | Johnson |
| 4,945,595 | A | 8/1990 | Meriweather |
| 4,965,903 | A | 10/1990 | Bish |
| 5,145,278 | A | 9/1992 | Lohrmann |
| 5,282,767 | A | 2/1994 | Gelardi |
| 5,414,885 | A | 5/1995 | Berlin et al. |
| 5,526,614 | A | 6/1996 | Huang |
| 5,651,154 | A | 7/1997 | Ahlskog et al. |
| 5,724,691 | A | 3/1998 | Wiedeck et al. |
| 5,924,152 | A | 7/1999 | Maier |

(Continued)

FOREIGN PATENT DOCUMENTS

| | | |
|---|---|---|
| CA | 2271403 | 10/2000 |

(Continued)

OTHER PUBLICATIONS

Kosteas, D. et al., "Modular Pedestrian Bridge in Aluminium", TRB Conference Jan. 9-13, 2000, Washington, D.C., U.S.A., 12 p.

(Continued)

*Primary Examiner*—Raymond W Addie

(57) ABSTRACT

The present invention is directed toward a novel moment resisting connection system, for use, but not limited to, with a pony-truss bridge system. The connection system comprises multi-hollow sections that can be, but are not limited to, extruded aluminum and a joint or node connector that can be casted, milled, forged or made by any other means.

32 Claims, 19 Drawing Sheets

U.S. PATENT DOCUMENTS

| | | | |
|---|---|---|---|
| 5,956,917 | A | 9/1999 | Reynolds |
| 6,009,586 | A | 1/2000 | Hawkes et al. |
| 6,056,240 | A | 5/2000 | Hagenlocher |
| 6,116,437 | A | 9/2000 | Rowe |
| 6,308,357 | B1 | 10/2001 | Maier et al. |
| 6,631,530 | B1 | 10/2003 | Makofsky |
| 6,672,654 | B2 | 1/2004 | Yamada et al. |
| 6,887,009 | B1 | 5/2005 | Lopez |
| 2002/0152715 | A1 | 10/2002 | Rotheroe |
| 2007/0008732 | A1 | 1/2007 | Robertson et al. |

FOREIGN PATENT DOCUMENTS

| | | | |
|---|---|---|---|
| DE | 10 2007 048 099 | A1 | 4/2009 |
| EP | 1 918 480 | A2 | 5/2008 |
| GB | 2 222 188 | A | 2/1990 |
| JP | 2001-140355 | | 5/2001 |
| RU | 2188287 | | 8/2002 |
| WO | 2006/119642 | A1 | 11/2006 |

OTHER PUBLICATIONS

International Search Report mailed on Feb. 1, 2010 in connection with International Patent Application No. PCT/CA2009/001404, 6 pages.

Written Opinion of the International Searching Authority mailed on Feb. 1, 2010 in connection with International Patent Application No. PCT/CA2009/001404, 7 pages.

Dimitris Kosteas and Peter Maier, "Modular Pedestrian Bridge in Aluminum", TRB Conference, Washington, D.C., U.S.A., Jan. 9-13, 2000, 11 pages.

20
21
22
3

SECTION B-B

SECTION C-C

SECTION D-D

SECTION E-E

SECTION F-F

MOMENT-RESISTING JOINT AND SYSTEM

CROSS-REFERENCE TO RELATED APPLICATIONS

The present application claims the benefit under 35 USC 120 of U.S. patent application Ser. No. 11/383,030 entitled "Moment-Resisting Joint and System" filed May 12, 2006 now U.S. Pat. No. 7,568,253 and hereby incorporated herein by reference in its entirety, which claims the benefit under 35 USC 119(e) of U.S. Provisional Application Ser. No. 60/679,884, filed May 12, 2005 in the United States of America, the disclosure of which is incorporated herein by reference in its entirety.

FIELD OF THE INVENTION

The present invention relates to a non-welded, structural connection system with moment resisting capability that can be used in a pony-truss bridge system or in diverse areas of architectural design, engineering, fabrication, and field erection structures using tubular members.

BACKGROUND OF THE INVENTION

Transportable and assemblable bridges are known which can provide a path for pedestrian, bicycles, light or heavy vehicles, across and over obstacles such as rivers and ravines. Some example of previous invention of prefabricated unit construction modular bridging systems may be found in U.S. Pat. Nos. 4,912,795/5,414,885/6,009,586/4,965,903/6,308,357/6,631,530 and 5,924,152.

Most of the time, fusion welding is employed to assemble such structures. However, it is well known in literature that aluminum fusion welding partially anneals the weld zone by creating a heat-affected-zone on the base metal which decreases its ultimate and yield strengths (example can be read in Dispersoid-Free Zones in the Heat-Affected Zone of Aluminum Alloy Welds—B. C. MEYER, H. DOYEN, D. EMANOWSKI, G. TEMPUS, T. HIRSCH, and P. MAYR). The present invention allows the fabrication of such structure using the full strength of aluminum because no welding for the main bearing structure would be required anymore. As an additional feature, the invention could allow anodizing, bake paint finished and easy transportation of all components to the erection site. The fabrication of all components could also be made by numerically controlled technologies that could increase accuracy as well as minimizing the fabrication time. Most of these additional features are not always possible for conventional aluminum welded structures since large structures request special transportation or would not fit into anodizing baths or on automated bake paint lines.

Another important advantage is that the invention allows all elements to be joined quickly together on site with a minimum of fasteners to form a bridge of the required length and strength within the overall limitations of the system whether it is made of aluminum, steel or other suitable material.

OBJECTS OF THE INVENTION

It is an object of the present invention to provide a mean to build transportable bridges which can be easily and readily transported in pieces by, for example, trucks, boats, aircrafts or helicopters.

It is a further object of the present invention to design such bridge pieces so that they may be carried or parachuted into the desired location.

It is yet another object of the present invention to allow for the bridge to be assembled as a self-supporting, projecting structure by relatively few people without using special equipment.

The invention can achieve one or more of the following advantages:

- Avoiding the creation of a heat-affected-zone for the main bearing elements;
- No certified welders are required to assemble the structure;
- Very long span possible due to the light weight of aluminum;
- Allowing architectural finishes such as anodizing, bake paint finishes and others;
- Pre-engineered structures that minimize the engineering design costs;
- Off-the-shelf elements that allow a structure to be shipped within few working days compared to weeks or months for a regular welded structure;
- Pre-fabricated elements with numeric controlled technologies reduces labour costs and poor accuracy;
- Decreasing assembly costs because the structure can be assembled quickly with minimal labour as well as a minimum number of fasteners;
- Ease of transportation (or exportation) allows all elements to be shipped on regular bundles or pallets independently of the final size of the complete structure.

The invention is especially advantageous for use in the construction of structures made from aluminum.

Other and further objects and advantages of the present invention will be obvious upon an understanding of the illustrative embodiments about to be described or will be indicated in the appended claims, and various advantages not referred to herein will occur to one skilled in the art upon employment of the invention in practice.

SUMMARY OF THE INVENTION

There is, therefore, provided in the practice of this invention a connection system with moment resisting capability, a novel framing element and a method of assembling same.

The present invention relates to a novel connection system with moment resisting capability being used, but not limited to, in a pony-truss bridge which can be assembled from individual prefabricated or off-the-shelf components.

Such structure may be constructed quickly to meet variation of spans or widths as well as to provide temporary or permanent access to all individuals, light vehicles and bicycles between two areas of different elevation or across and over obstacles or may be used as a walkway system to be cantilevered from the existing bridge structure, thereby providing suitable walkway widths on both sides of a bridge without reducing the width of existing traffic lanes.

The connection system can be attached to the tension chord of a pony-truss bridge to resist bending moment such as required for the top chord stability (top chord stability criteria utilizing elastic lateral restraints—TV Galambos, Timoshenko). To assemble the connection system, three or more multi-hollow members are slid into female node cavities and preferably locked in place utilizing a fastener, usually a bolt, that goes through their neutral axis. The framing elements are positioned accurately into the node's cavities according to fabrication accuracy which may be done by numeric controlled technologies. The framing member attachment or fastener means is preferably done within the area of its neutral axis by typically, but not limited to, a bolt that acts to absorb the tensile forces exerted on to the system without compromising the node connection. Once the member is in place, it can be secured by a bolt, a threaded rod or any other means that will keep the member into place ideally, but not limited to, within the neutral axis region. The external wall of the element has a friction contact with the internal side cavity which will resist the compression forces or bending moments exerted onto the element therefore it can transfer such forces or moment to the node without compromising the node connection.

A given connection system is comprised of a joint or node and associated interlinked members to be used in pony-truss bridges system or any other applicable engineered structures. A preferred embodiment of the connection system employs custom aluminum extruded hollow elements and a node and bolts or rods to secure elements to the node.

Pony-truss bridge or other structures may be wholly or partially constructed using the moment resisting connectors in accordance with the invention. Such a structure is comprised of a plurality of framing elements, joint or node connectors, and attachment means.

To assemble a structure with the use of the invention, some members are positioned into the node's cavities given at the same time the final alignment due to the perfect fit inside the cavity while another member, generally a chord, is liked onto the channel's node. Ideally, all members are secured with fasteners while some have only one fastener that goes through their neutral axis and another one, generally the chord, has at least two bolts that secure it through the node's channel. For ease of reference, every time the word <<cavity>> is used hereinafter, it is to be understood a cavity with a specific depth to confer moment resisting capability. This depth can be determined with calculation, benchmark tests or other known means.

An example of a structure using the invention is a transportable bridge or other similar structure having two longitudinal vertical trusses, comprising: plural bridge elements connected to each other by rigid nodes on a chord. The structure includes: a decking extending across a width of the bridge and having an horizontal triangular or Vierendeel truss depending on the lateral forces being acting on the structure (usually created by wind loads). Each vertical truss of the structure (main carrying members) resists gravity live and dead loads and brings sufficient stiffness to limit the deflection in conjunction of acting as a guard-rail. When the invention is being used for a pony-truss bridge system both vertical trusses have a bottom chord and an oppositely disposed top chord, the lower chord portion of the truss being connected to the transversals usually also made of a multi-hollow beams and multi-hollow diagonal struts by the rigid node herein named connection system.

The bridge vertical trusses, and thus the main load carrying members of the bridge, has essentially five different components: the top and bottom chords, the diagonals struts and/or vertical posts, the top connector (superior node) and the bottom connector (inferior node) which one connect both vertical trusses by horizontal floor members. These horizontal members can support what is called stringers located underneath a decking. The decking can be however made of different type of material but preferably, it could be made of a material having a low specific mass, for example composites or aluminum. The triangular trusses are dimensioned to reduce their size and corresponding weight. Consequently, the decking and the triangular trusses can be made so light that eventually the bridge structure could land on floating dock without the necessity to add additional buoyancy to it. Eventually the reduced weight of the individual components could allow the bridge to be manually assembled and carried by relatively few people.

When assembled, the bridge has a half-through shape, and consists essentially of longitudinally extending main support vertical trusses, and a decking.

The connection system being used as a moment resisting connector for the half-through bridge structure that can be eventually used to construct footbridges, golf course bridges, skywalks, overpasses, vehicular access bridges, bicycle path bridge, trail bridges, recreational bridges, walkways and so.

Further, freeway overpasses and underpasses built in the last decades frequently lack adequate walkways in situations where pedestrians or bicycles are permitted. In many communities, such barriers prevent pedestrian/bicycles access between neighborhoods, schools, and employment centers. In such cases the invention could serve to construct bridges that can be placed on the side of existing narrow bridges to give better access to the communities.

To eliminate excessive free play between the connected components when the bridge is assembled, the triangular trusses are interlockingly connected with each other. The interlocking connection includes at least one fastener that goes through the neutral axis of the diagonal and/or vertical struts, transversal beams as well as a minimum of fasteners to hold the connector to the bottom chord of the truss. Fasteners that secure the struts to the connector act in tension while fasteners that hold the connector to the chords act in shear. Further, the top chord is linked to the diagonal and/or vertical struts with the mean of a pin connection working in shear.

A lubricant can be disposed at the interface of the connection of framing elements and node connectors to allow an easier disassembling if the bridge is temporarily installed.

The invention will be described below in greater detail in connection with embodiments thereof that are illustrated in the drawing figures.

The features of the present invention which are believed to be novel are set forth with particularity in the appended claims.

BRIEF DESCRIPTION OF THE DRAWINGS

A preferred embodiment of the present invention will be described in greater detail below with reference to the following drawings, in which.

DETAILED DESCRIPTION OF THE PREFERRED EMBODIMENT

Figure 1:
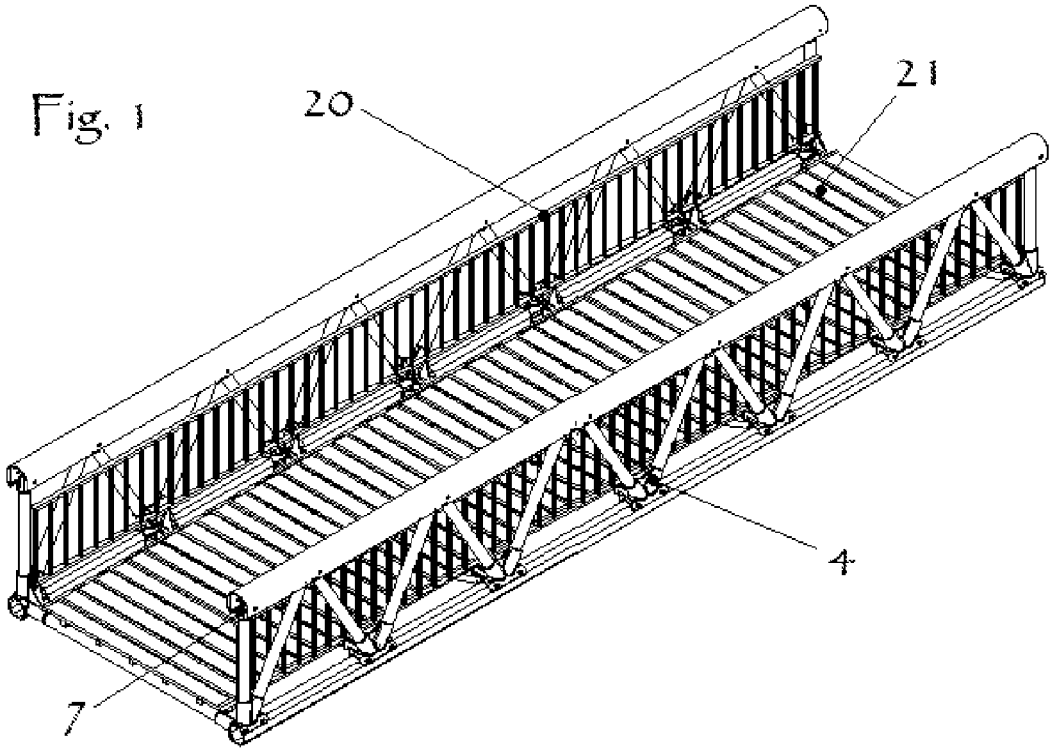
FIG. 1 is a perspective view of a fully assembled modular bridge in accordance with the present invention.

Turning to FIG. 1, a modular pedestrian bridge 1 is shown comprising a plurality of individual elements connected to each other by the mean of node connectors 4 and 7. Fencing 20 connect to the vertical trusses on the inside as shown or eventually on the outside. A decking 21, or eventually floor boards, is placed on top of the stringers (not shown) and acts as a floor to be walked on. Ends of the bridge, when installed, are connected to respective end footings (not shown) via respective anchors (not shown).

The modular sections of fencing 20 may be fabricated to any suitable length. Typical sections contemplated are 5 feet, 10 feet, 15 or 20 feet in length.

Figure 2:
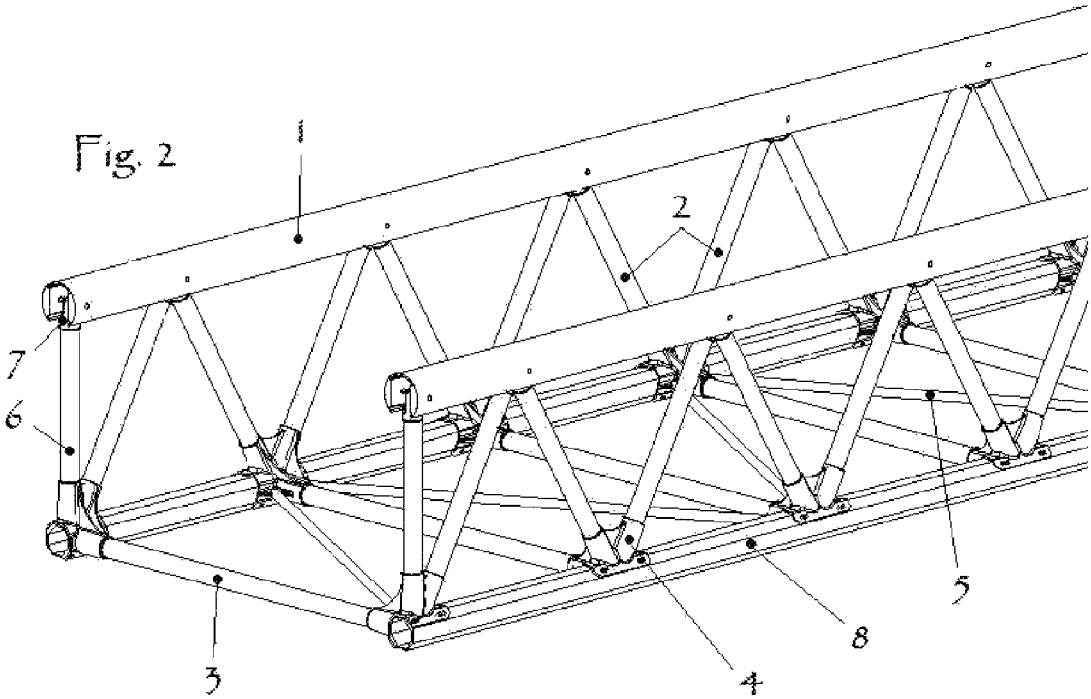
FIG. 2 is a perspective view of the main carrying members of the bridge shown in FIG. 1 prior to installation of floor boards, fencing and stringers.

FIG. 2 shows the bridge in FIG. 1 prior to installation of the decking and stringers. As can be seen from FIG. 2, both vertical trusses are linked to each other via a plurality of transversals 3 and diagonals 5 extending there between.

Figure 3:
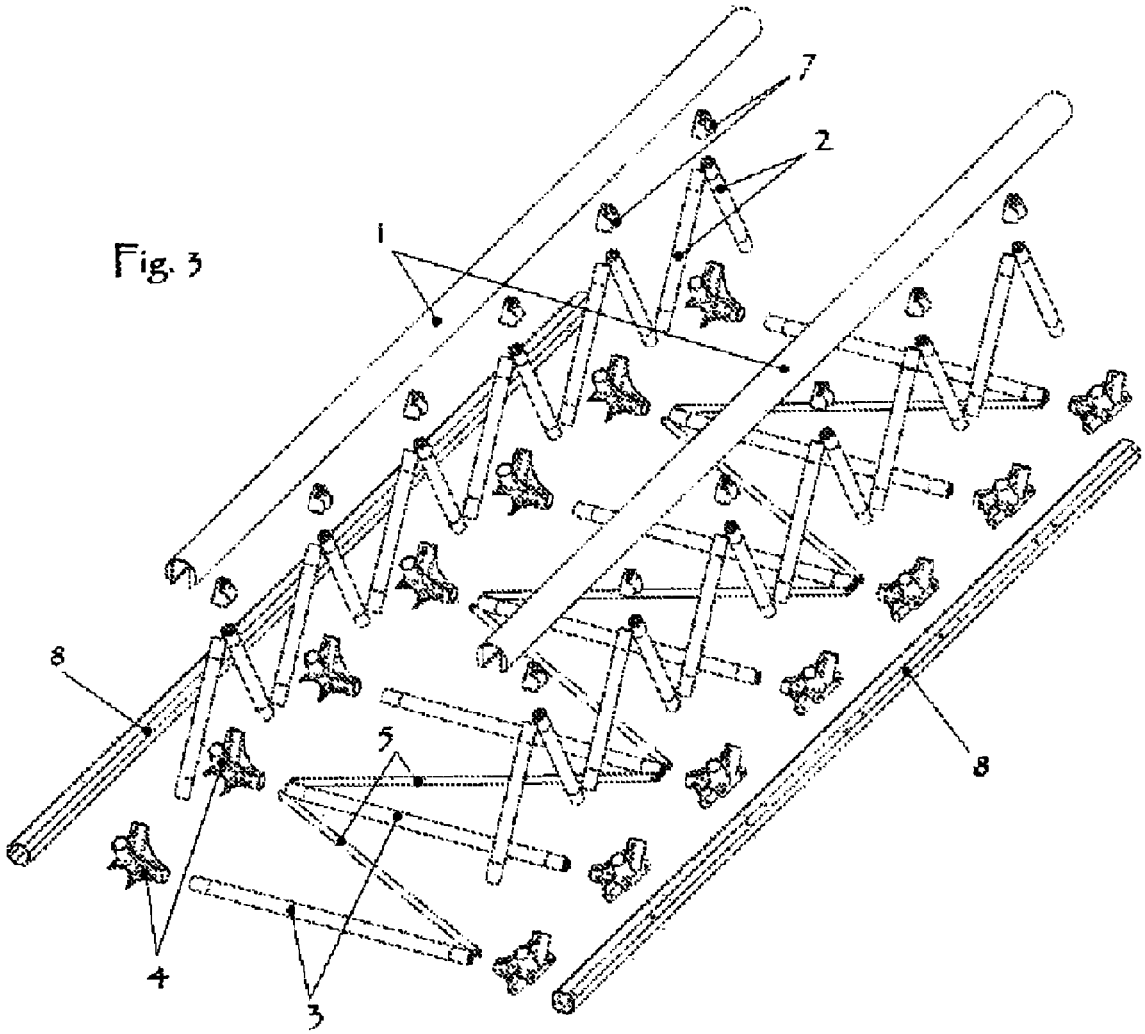
FIG. 3 is an exploded perspective view of the bridge understructure shown in FIG. 2.

FIG. 3 illustrates an exploded view of the main bearing structure comprising a plurality of linear elements such as two tension chords 8, two compression chords 1, a plurality of diagonals 2, transversals 3, floor diagonals 5 all connected to each other by the mean of top node connectors 7 and bottom node connectors 4.

Figure 4:
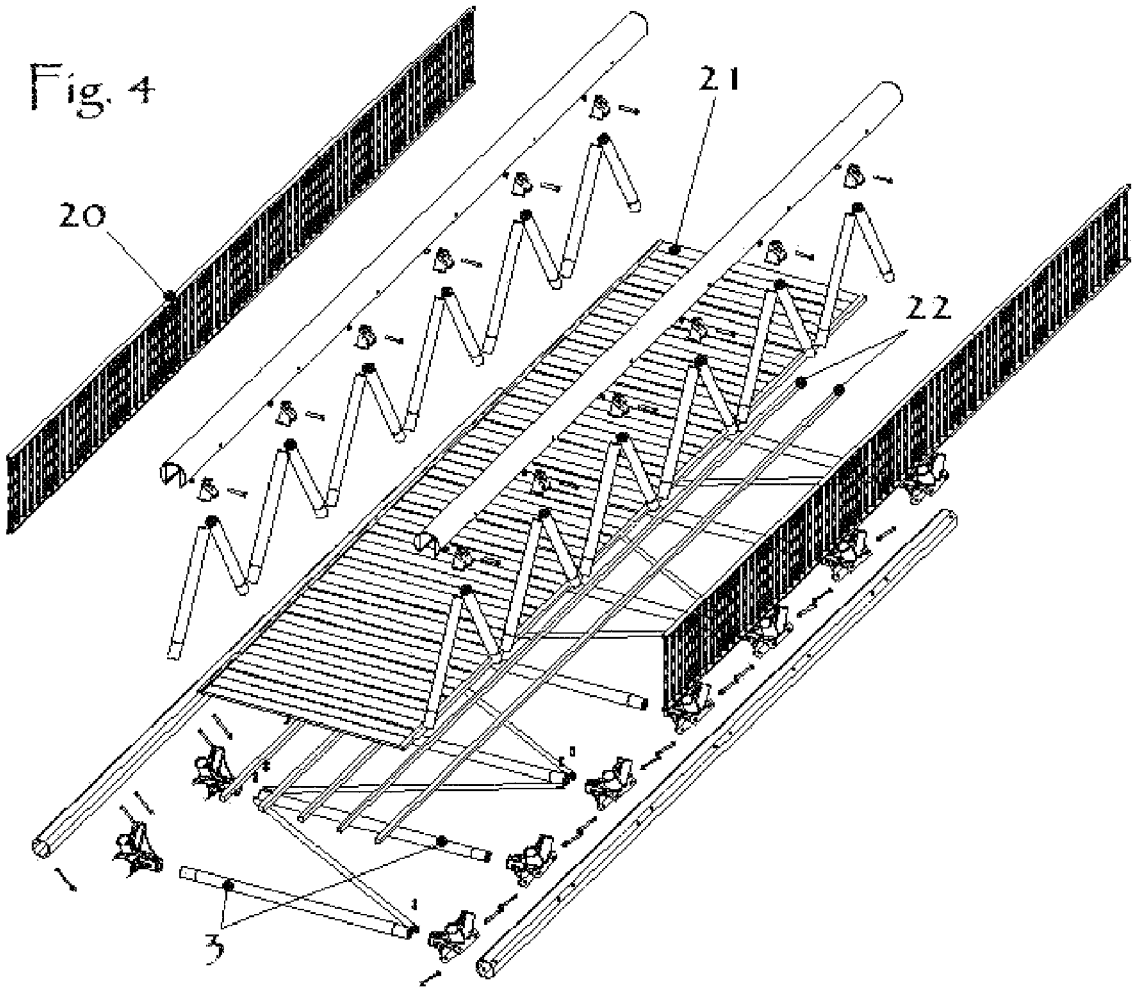
FIG. 4 is an exploded perspective view of the bridge shown in FIG. 1 including floor boards, fencing and stringers.

Next, as shown with reference to FIG. 4, longitudinal stringers 22 are placed and secured on top of the transversals 3. A decking is secured to the stringers via fasteners (not shown). A fencing system 20 (optional) can be attached to the vertical main load carrying trusses.

Figure 5:
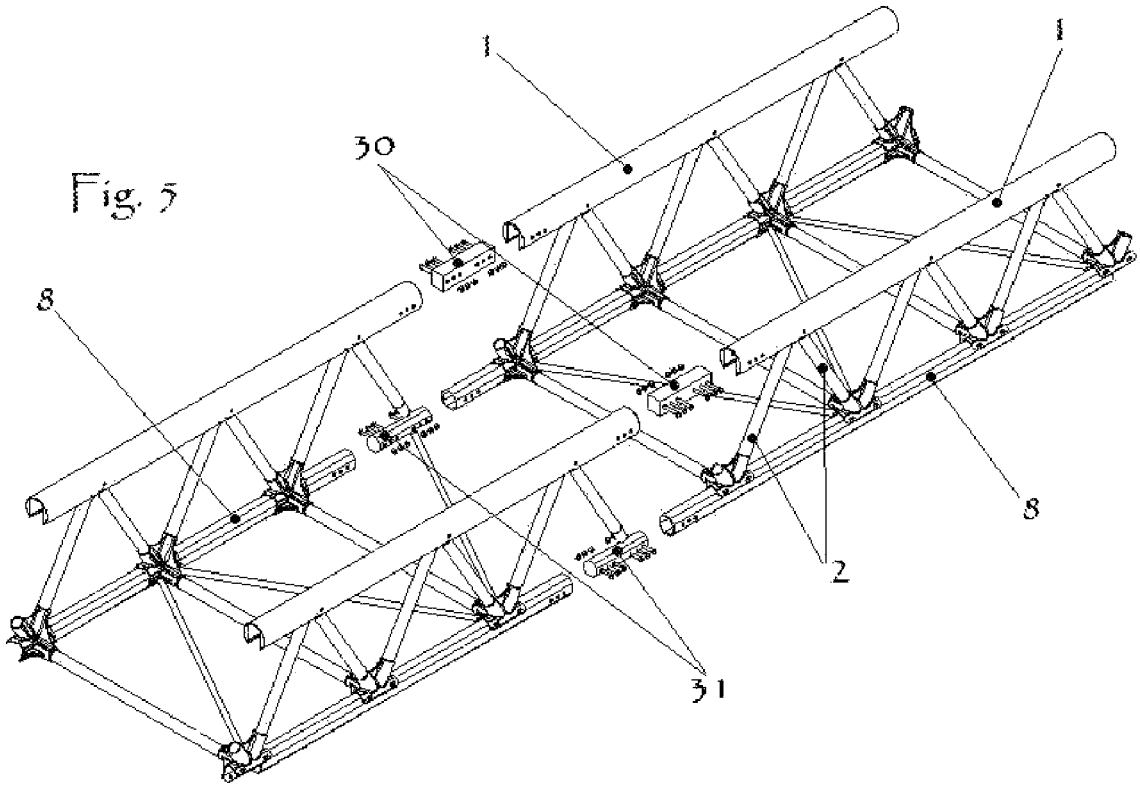
FIG. 5 is a perspective view of a splice in the bridge of FIG. 2.

Turning to FIG. 5, successive ones of the vertical trusses are shown comprising top and bottom chord members 1 and 8 connected via splices 30 and 31. Diagonal members 2 provide additional support.

Figure 6:
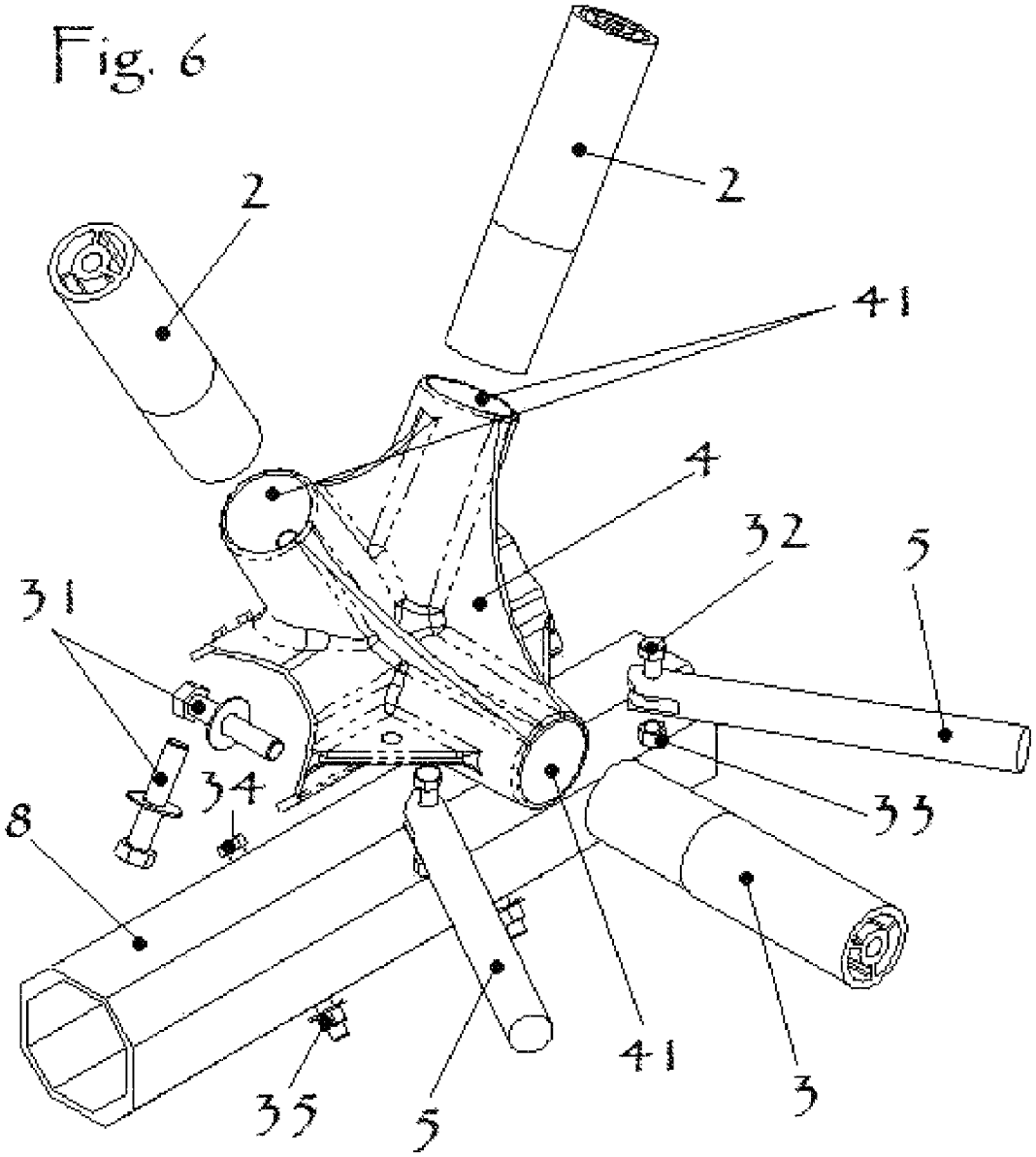
FIG. 6 is a exploded perspective view of the connection system with moment resisting capability shown in all previous figures (FIGS. 1, 2, 3, 4 & 5)
Figure 7:
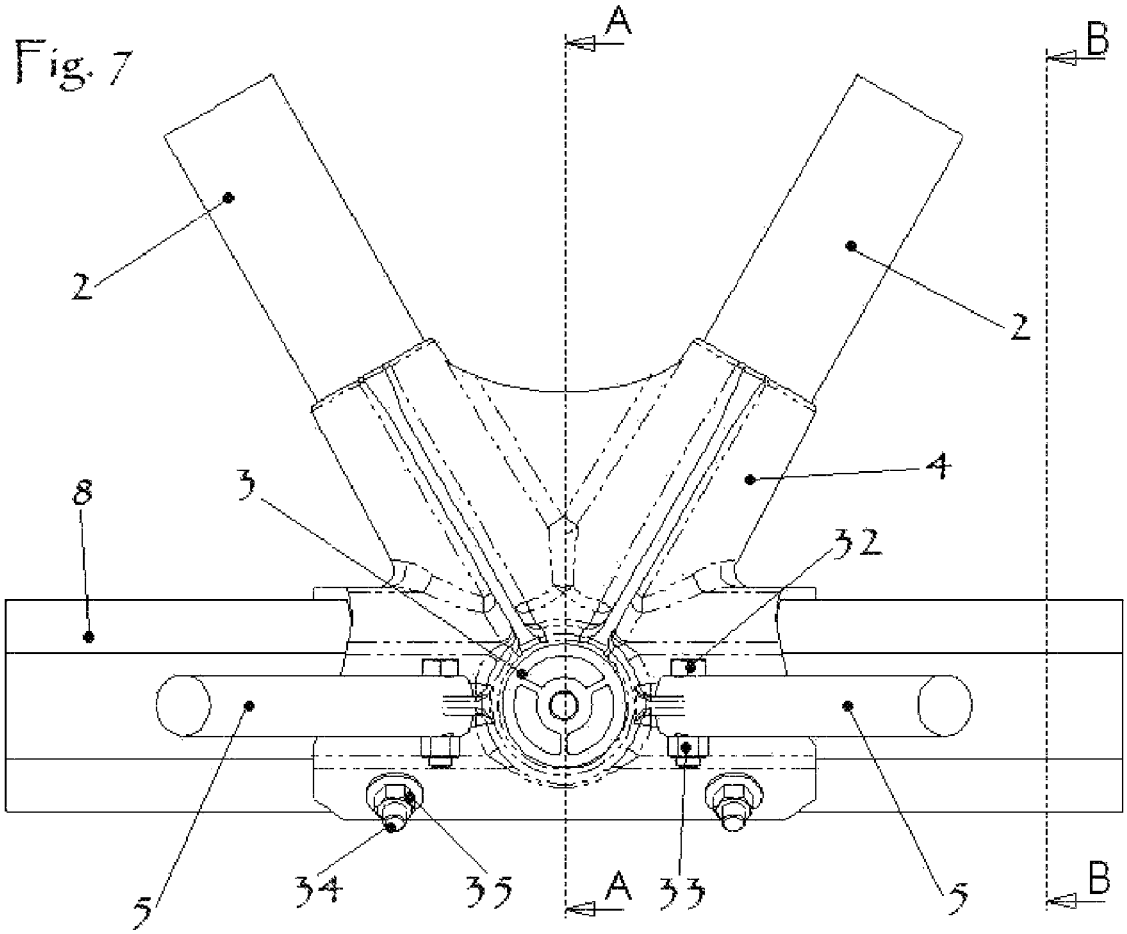
FIG. 7 is an elevation view of the connection system shown in FIG. 6 when fully assembled.
Figure 16:
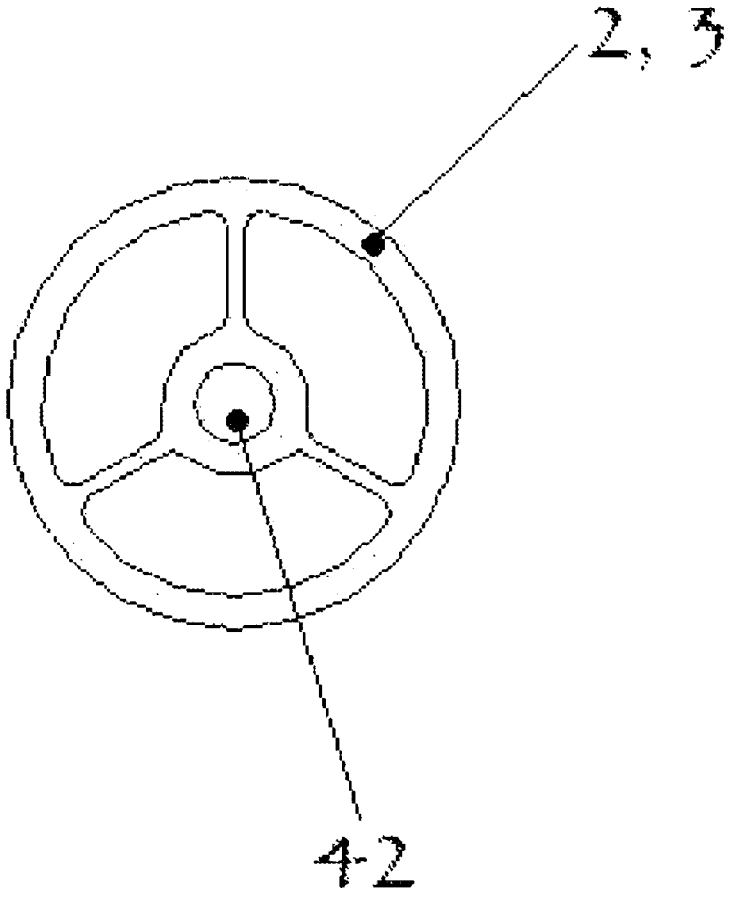
FIG. 16 is a section view of the diagonal/vertical struts and transversals.

The bottom node connector is shown in greater detail with reference to FIG. 6 comprising diagonals 2, tension chord 8, floor diagonals 5, transversals beams 3 and a node connector 4 that have the ability to transfer bending moments. The diagonals and transversals are inserted into corresponding cavities thereby 41 at the distal ends of the diagonals and transversals members 2 and 3. Ideally, the diagonals and transversals have tapered ends for insertion into corresponding ones of the cavities. Their ends can be milled, turned, swaged or bring to this particular shape by the mean of any way. The cavities however could be or not to be of a similar corresponding shape depending on temporary or permanent use of the structure (vertical or tapered inside wall of cavities). The best way to secure such diagonals and transversals inside the node connector could be done by the use of a bolt that is screwed inside the internal region 42 of the multi-hollow cavity extruded tube as shown in FIG. 16 and as shown in greater detail with reference to FIGS. 8 and 10. The node connector is attached to the tension chord by a pair of bolts 34 and nuts 35 through two like pairs of holes adapted to align the node 4 and the chord 8. Both floor diagonals attach to the node connector with bolts 32 and nuts 33.

The node connector form a solid and extremely stable connection between the hollow tubing chord members 8, the transversal beam 3 and the diagonals 2 for maintaining structural integrity throughout the chord members 8, thereby overcoming lateral stability problems inherent in half through (pony) bridge. As shown with reference to FIG. 6, bolts that are used to secure diagonals and transversals are hidden so they cannot be unscrewed while the node is attached to the chord providing additional safety against thief or sabotage. Additionally, anti thief nuts can be used instead of regular nuts to secure the node connector to the chord 35. The resulting connector is in a visually attractive appearance.

Figure 8:
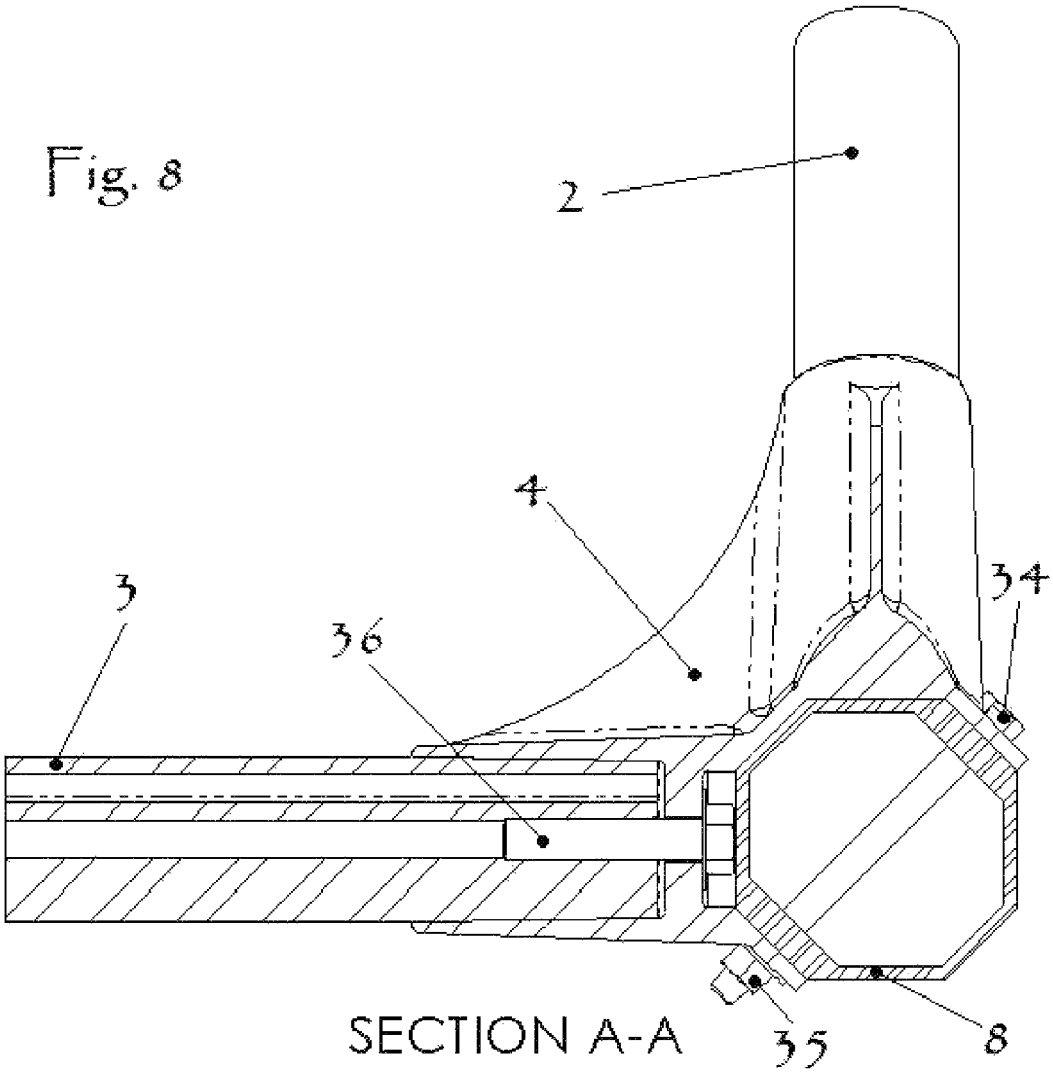
FIG. 8 is a section view along lines A-A in FIG. 7 when fully assembled.
Figure 9:
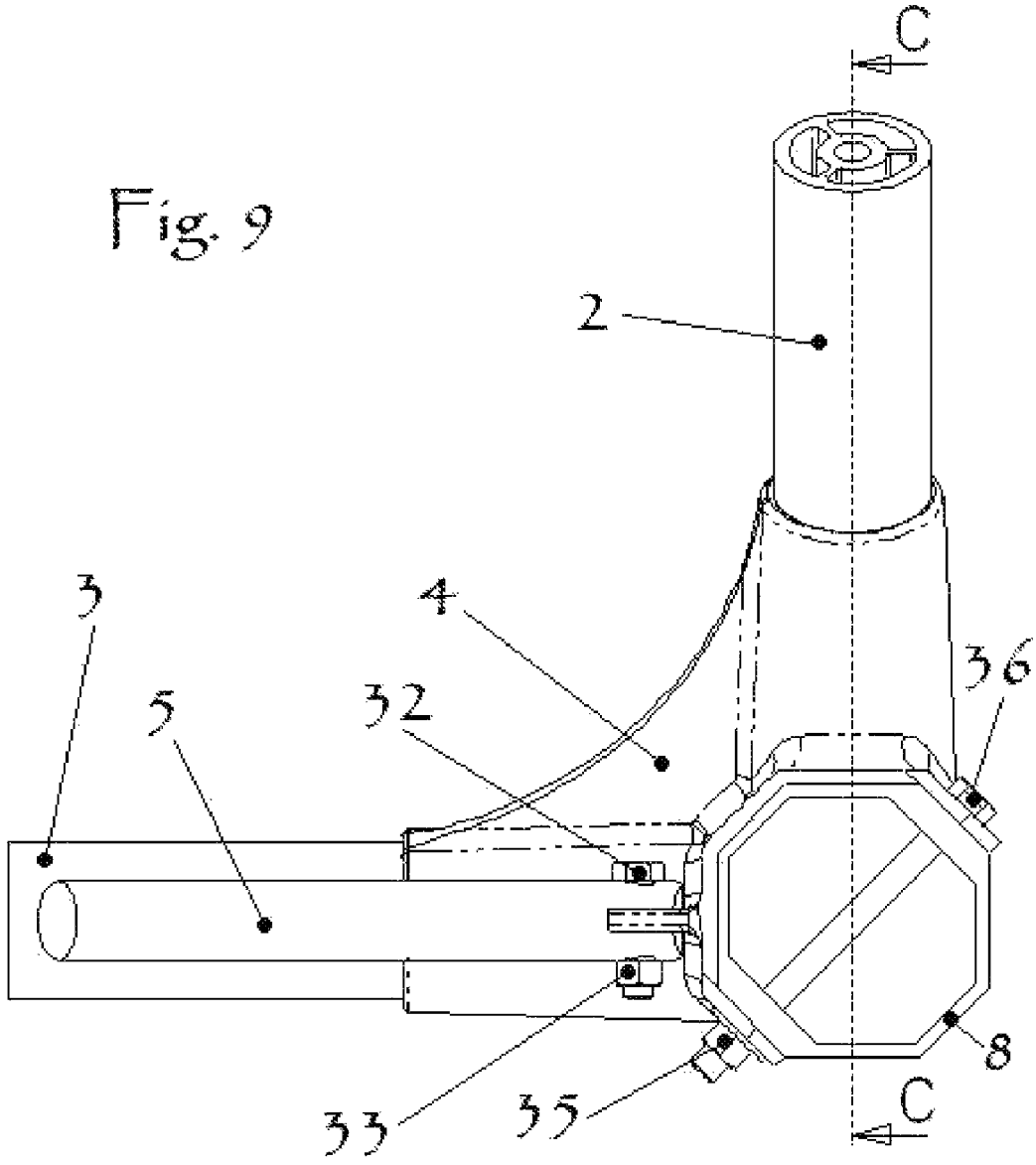
FIG. 9 is a section view along lines B-B in FIG. 7 when fully assembled.
Figure 10:
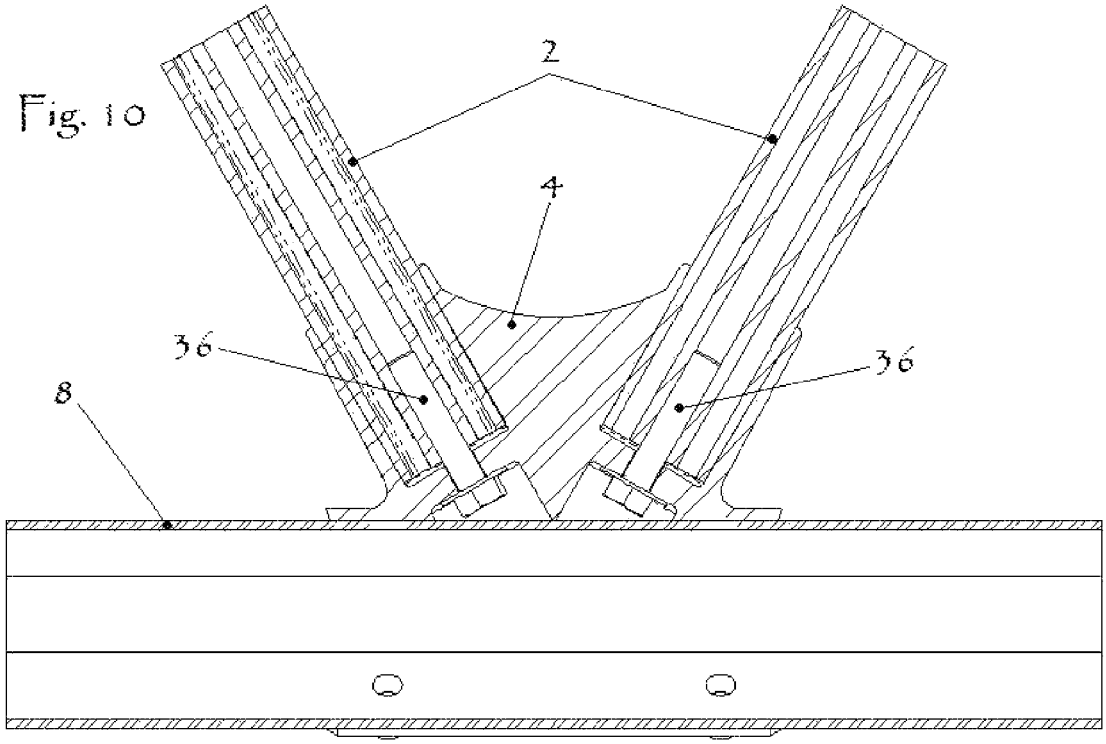
FIG. 10 is a section view of along lines C-C in FIG. 9 when fully assembled.

Turning now to FIGS. 7, 8, 9 and 10, the first figure is an elevation view from the inside of the bridge. Element 3 is the transversal hollow beam and elements 5 are the diagonal bracings to resist any horizontal loading act on the projected area of the bridge structure. Elements 2 are the diagonals that support the compression chord (not shown). They mainly resist tension and compression forces but they also transfer some bending moment to the floor beams as well as they transfer torsion to the tension chord 8 since they stabilize the compression chord which one tend to buckle. FIG. 8 shows a view along lines A-A in FIG. 7. As it can be seen a fastener 36, generally a bolt, secures the floor beam 3 into the node 4 cavity. Bolt 34 secure the node 4 to the tension chord 8. FIG. 9 shows a view along lines B-B in FIG. 7. FIG. 10 shows a view along lines C-C in FIG. 9. Once again we find two fasteners, generally bolts, to secure both diagonal members 2 into the node 4 cavities.

Figure 11:
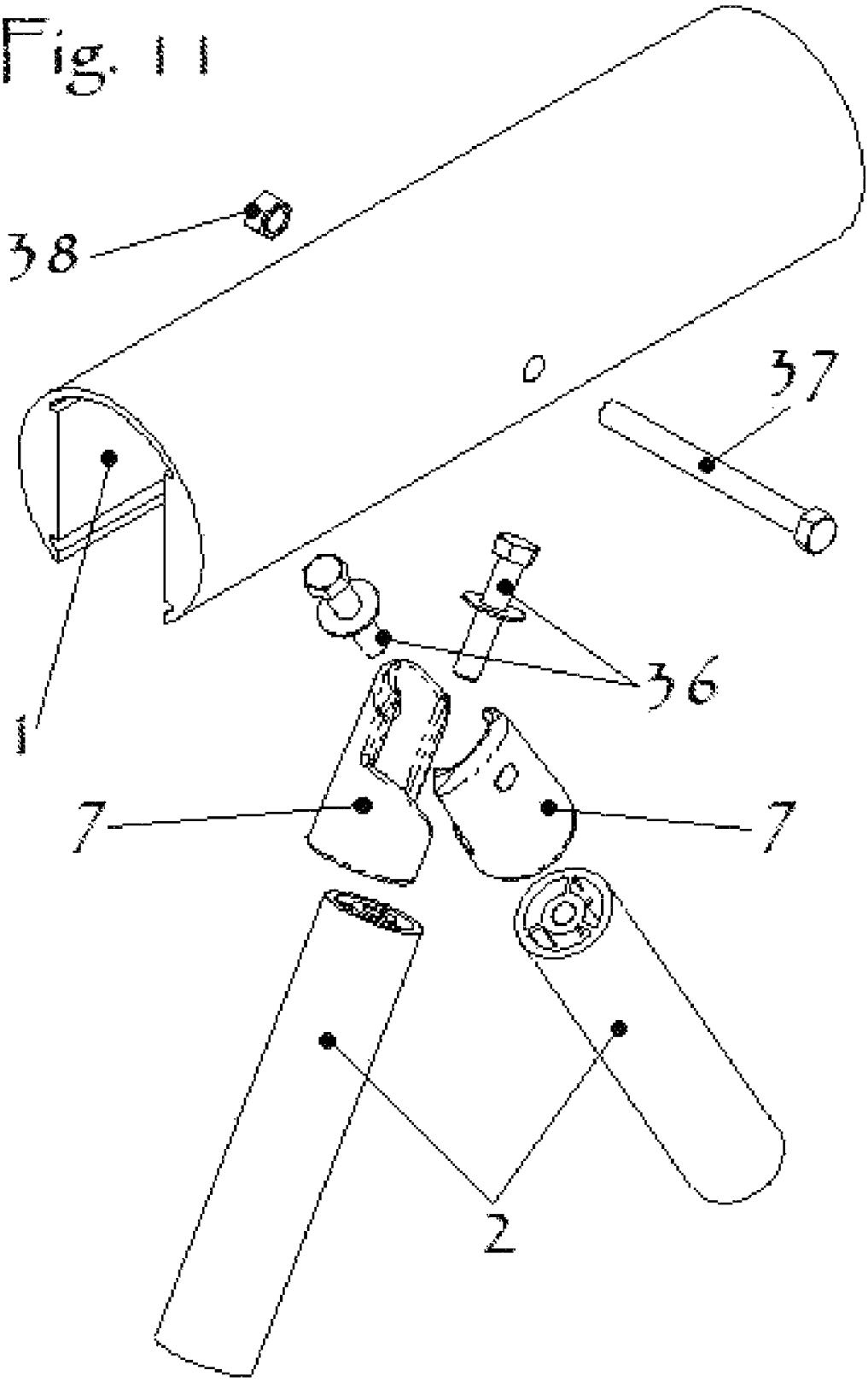
FIG. 11 is a exploded perspective view of the compression chord connector shown in FIGS. 1, 2, 3, 4 & 5.

As shown best with reference to FIG. 11, the exploded view of the compression node connector shows two diagonals 2, two superior node connectors 7, a compression chord 1 and their associated fasteners 36, 37 and 38, generally bolts. The diagonals 2 are linked to the superior nodes generally by the mean of one bolt 36 screwed into their neutral axis. The superior node connectors are however linked to the compression chord by the mean of a bolt 37 that fits into a hole in the compression chord 1. The bolt 37 is secured in place with a nut 38 or preferably with an antitheft nut (not shown).

Figure 12:
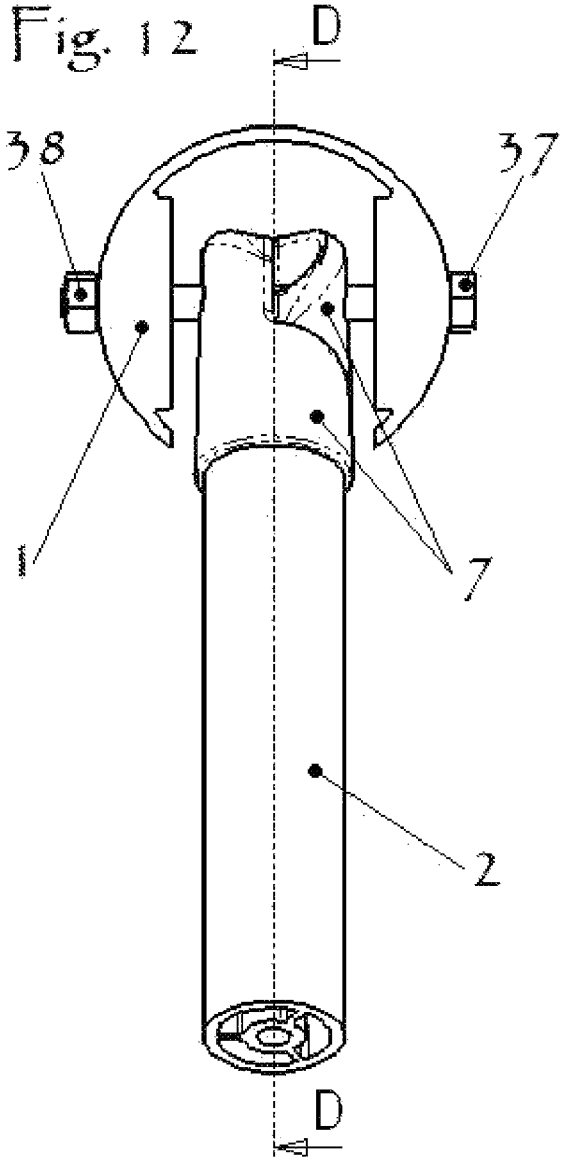
FIG. 12 a section view of the superior connector shown in FIG. 11 when fully assembled.

FIG. 12 shows a sectional view from the compression chord 1. It is therefore acknowledge that the bolt 37 works in shear while the fasteners (not shown) that secure the diagonal 2 on the superior node 7 works in tension.

Figure 13:
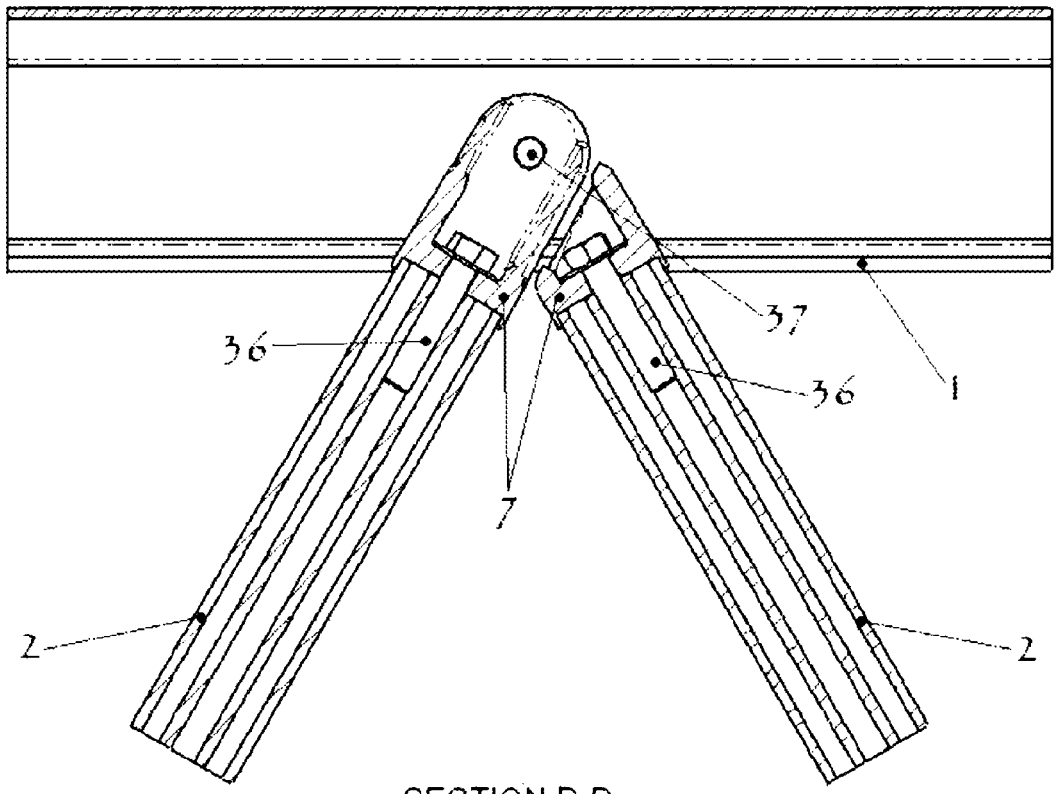
FIG. 13 is a section view along lines D-D in FIG. 12 when fully assembled.

FIG. 13 shows a view along lines D-D in FIG. 12. As it is shown fasteners, generally bolts 36, secure the diagonals 2 on the superior node 7. A fastener 37 goes through a hole in the compression chord 1.

Figure 14:
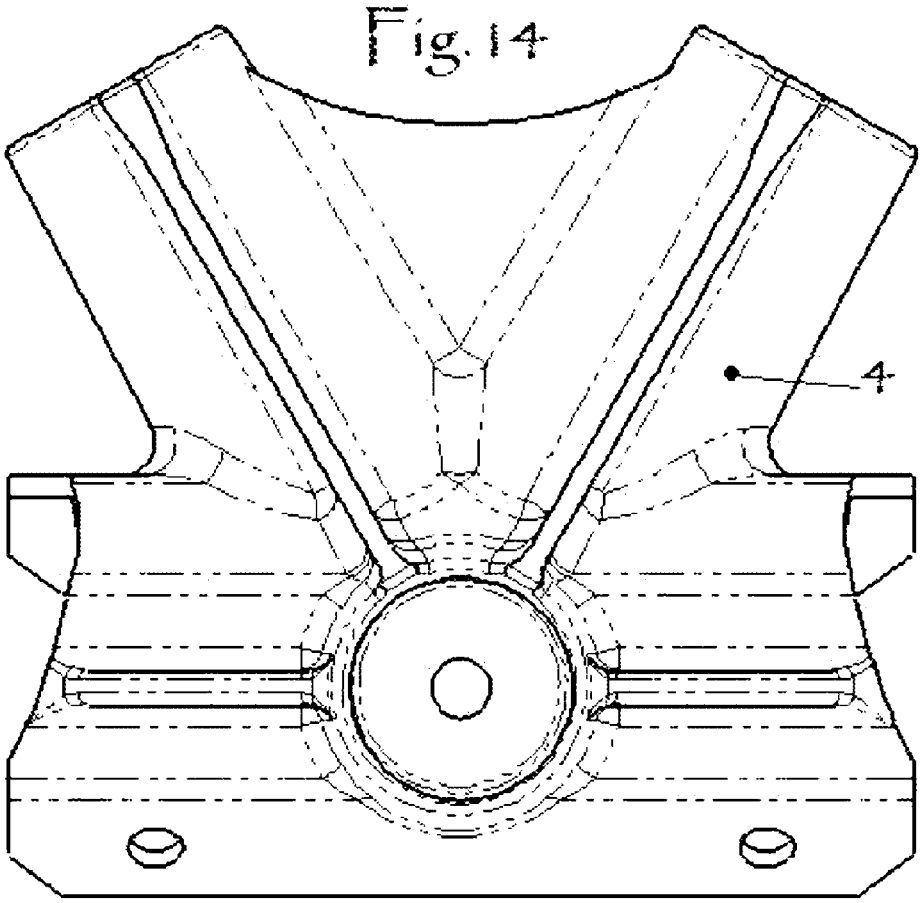
FIG. 14 is an elevation view of the inferior node connector with moment resisting capabilities.
Figure 15:
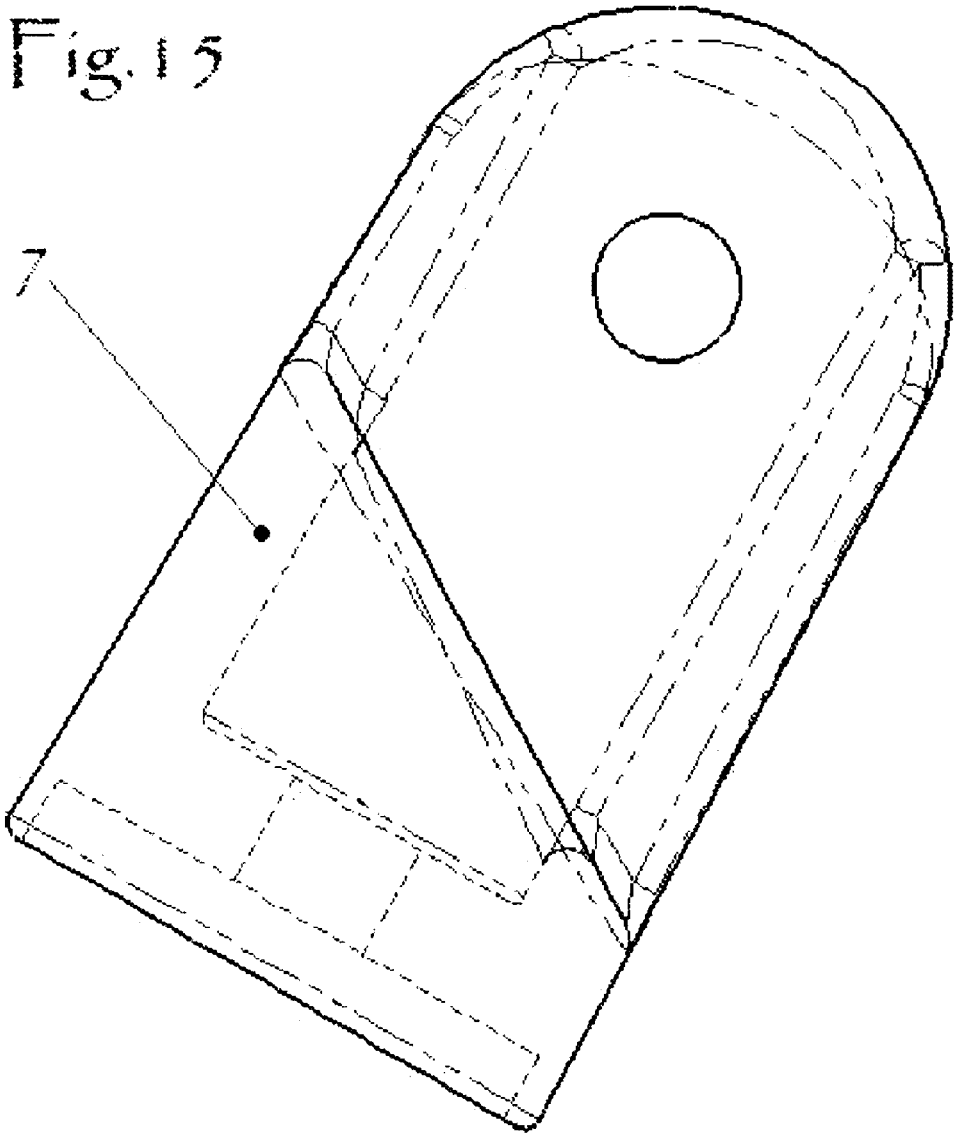
FIG. 15 is an elevation view of the superior node connector.

FIG. 14 shows the moment resisting node connector 4 while FIG. 15 shows the superior node connector which one are generally liked to a multi-hollow extruded shape as it is shown in FIG. 16. Even if the cylindrical framing element 2, 3 has been shown having a circular section, it is to be noted that the section of the framing element could have any other suitable section such as, for example curved section (e.g. ellipsoidal) or polygonal section (e.g. square, triangular or else).

Figure 17:
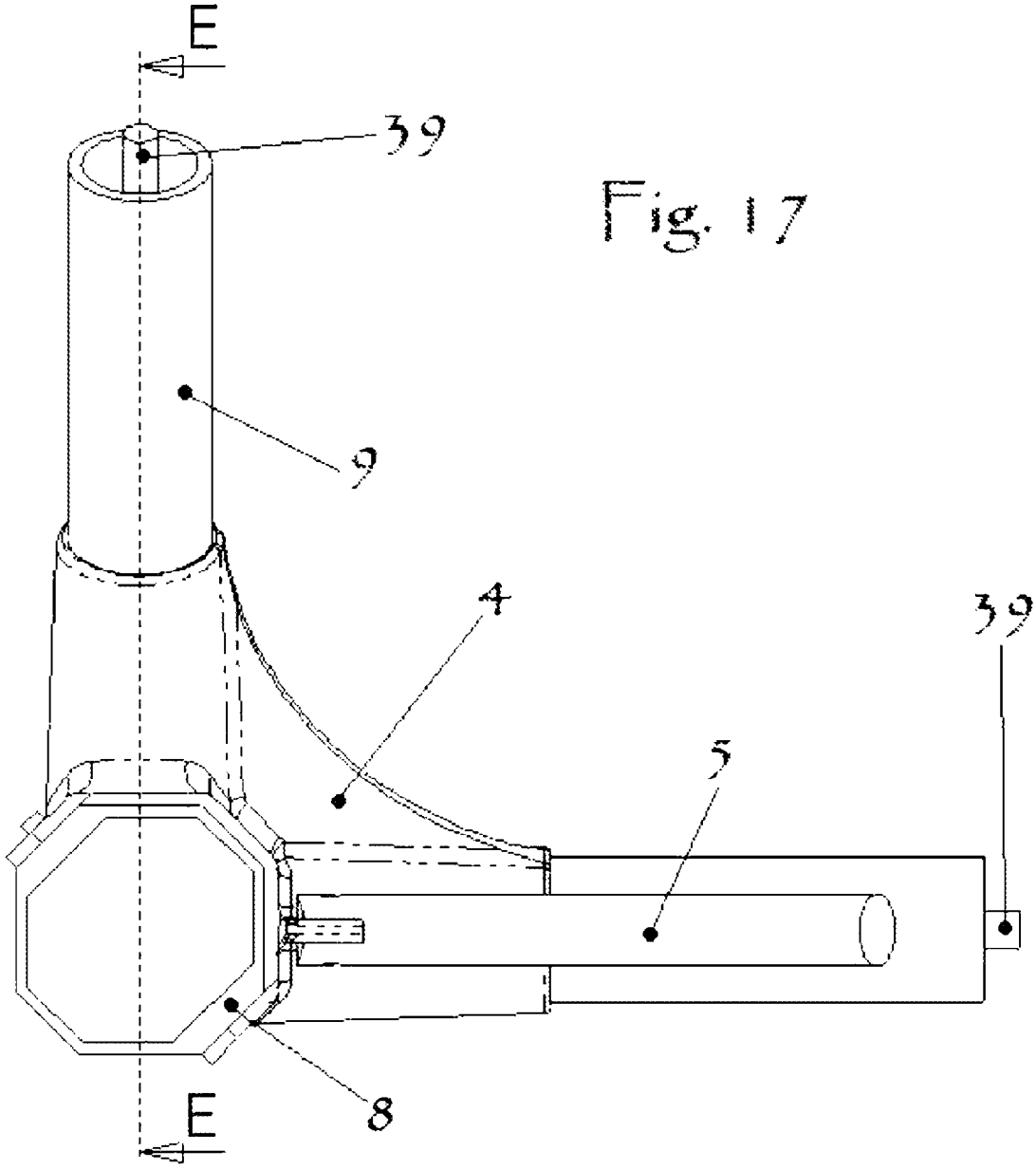
FIG. 17 is an alternative for the inferior connector element. It is therefore possible that the struts to be made of a hollow section, usually circular, and the tension forces can be taken by a rod that is independently located near the strut neutral axis.
Figure 18:
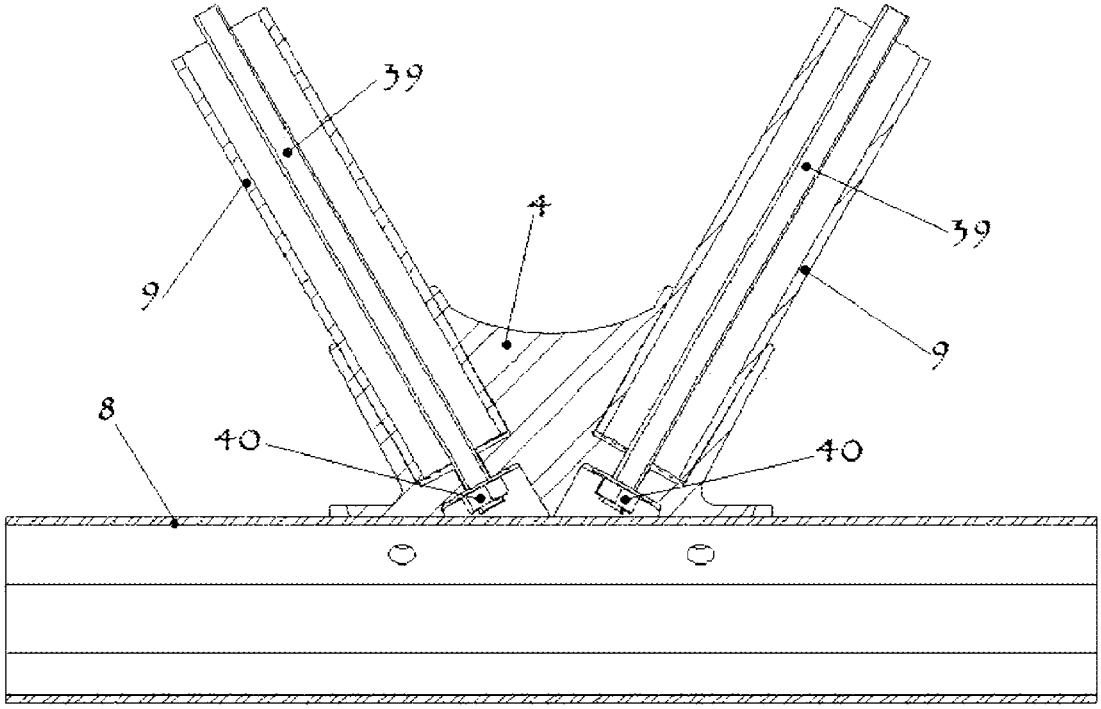
FIG. 18 is a section view along lines E-E in FIG. 17 when fully assembled.

FIG. 17 shows a possible alternative to the use of a multi-hollow section shown in FIG. 16. It is therefore possible to use, but not preferred, a regular hollow shape that could be secured into the node cavities by the mean of a rod partially or completely threaded. FIG. 18 shown a view along lines E-E in FIG. 17. A rod 39 can run on or near the neutral axis of a tube. A nut 40 can give a pre-tension to maintain the tube inside the cavity with adequate pressure.

Figure 19:
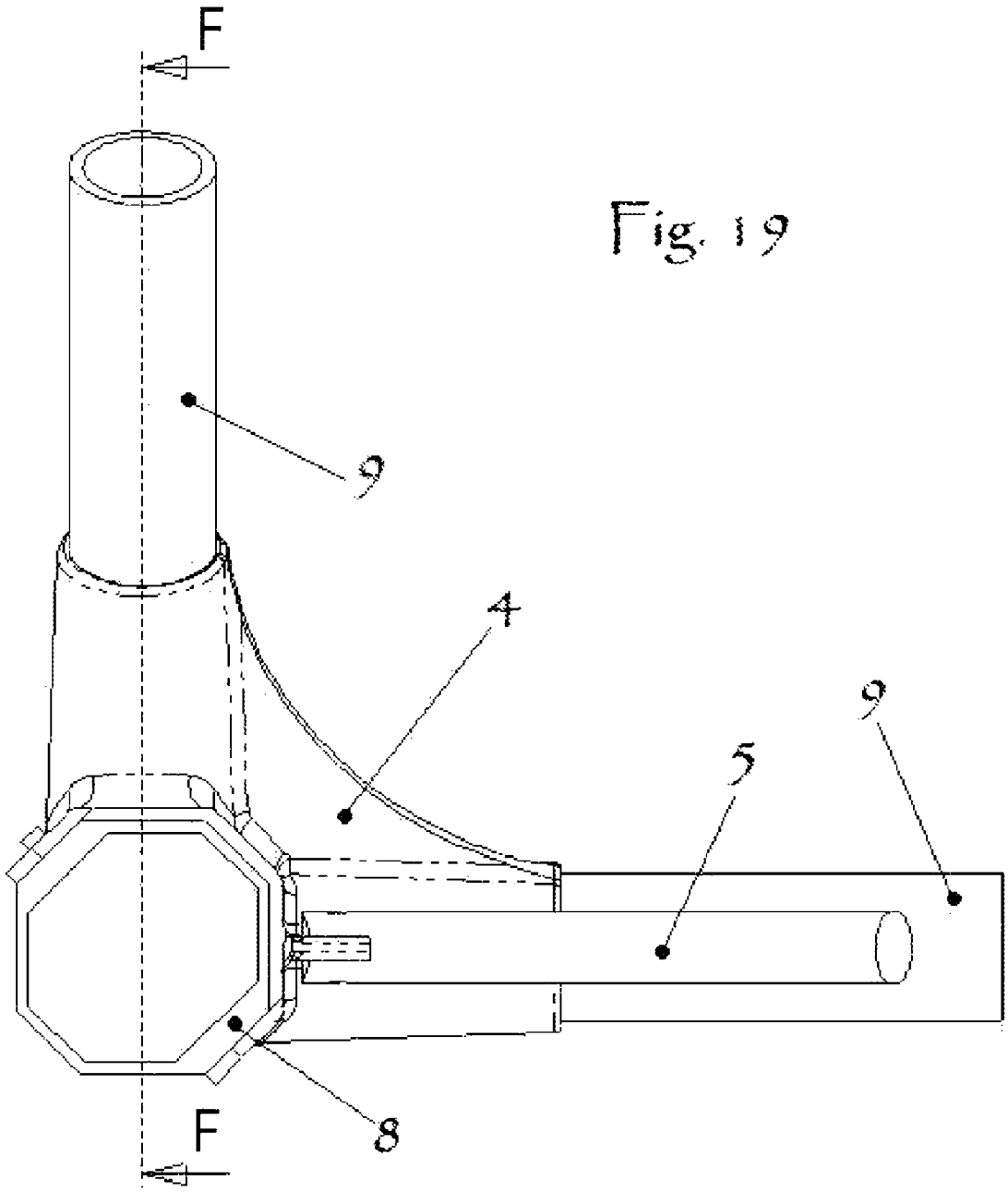
FIG. 19 is another alternative for the inferior connector element. It is therefore possible that the struts to be made of a hollow section, usually circular, and the tension forces can be taken by an insert located inside the hollow section.
Figure 20:
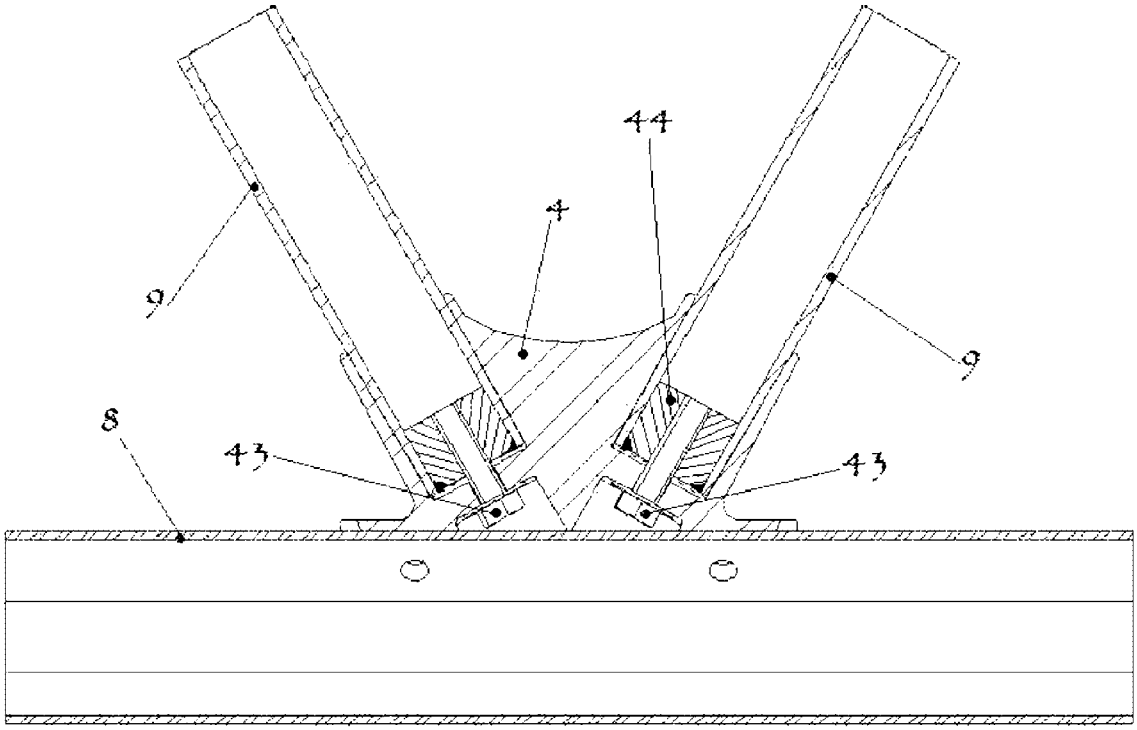
FIG. 20 is a section view along lines F-F in FIG. 19 when fully assembled.

In addition to the alternative shown in FIG. 17, FIG. 19 shows another alternative that could be possible, but not necessary desired, as it could allow the element 9 (a hollow section) to be secured into place with the mean of a threaded insert 44 as shown in FIG. 20 that would fit the inside of the element 9. The insert 44 could be maintained inside the element 9 by the mean of welding or by any other mean.

FIG. 20 is a view along lines F-F in FIG. 19 and it shows the insert that could be achieved to secure in place the element 9 into place with a fastener 43, generally a bolt.

Thus, in final assembly the center load of diagonals or verticals are supported equally by horizontal or tapered wall when the elements work in compression or by the mean of the fasteners, generally bolts, when the diagonals or verticals work in tension. The transversals however transfer their moment to the node with the friction applied along the internal walls.

Accordingly, a maximum dimension of transversals 3 and diagonals 2 may be accommodated irrespective of the width and length of the bridge. By way of contrast, know prior art transversals or diagonals connections require multiple welds, generally fillet weld type, which one are not desired since it weak the base material when aluminum is employed for such structure.

Accordingly, an important aspect of the present invention is the improved mechanical properties because of avoiding welding of the main structural members. The connector acts as a rigid node able to carry and transfer tension, compression, torsional and bending moments provided by usually only one interlocking fastener running through the neutral axis of diagonals/verticals and transversals.

Preferably, all metallic structural components of the pedestrian bridge in FIG. 1 in accordance with present invention are made of aluminum with the possibility to hard anodize each individual element, for forming an aesthetically pleasing and scratch resistant surface.

Other embodiments and variations of the present invention are contemplated.

For example, the connector of the present invention may be advantageously applied to virtually any structures using standard or custom hollow tubing. To that end, the inventive moment resisting connector could be used in such diverse applications as furniture construction, building construction, fencing, bridges, towers, flag post bases, gantry of motorway etc., any of which may be fabricated from stainless steel, plastic, steel or other suitable material.

Furthermore, whereas the preferred embodiment of the tapered end element which may usually be milled, swaged or turned by numeric controlled technologies, it is contemplated that end portions of the elements 2 and 3 may also be strait.

As a further alternative, the node configuration may be fabricated via specialized machining tools from a solid block or cast from metal or eventually made of composites.

Moreover, whereas the preferred embodiment discloses a structural connection for use with multi-hollow cross-sectional elements 2 and 3 in FIG. 16, it is contemplated that the cooperating element and cavity aspect of the present invention may be applied equally to hollow tubing sections having square, circular or other cross-section.

All such embodiments or variations are believed to be within a sphere and scope of the present invention as defined by the claims appended hereto.

Although preferred embodiments of the invention have been described in detail herein and illustrated in the accompanying figures, it is to be understood that the invention is not limited to these precise embodiments and that various changes and modifications may be effected therein without departing from the scope or spirit of the present invention. For example, the node resisting joint and system of the invention may be used to construct roofs and other structures using nodes to join elongated members.

The invention claimed is:

1. A moment transferring assembly, comprising:

a) a connector node element having a plurality of cavities;

b) a plurality of framing members for mounting to the connector node element into respective ones of the cavities;

c) each framing member being generally elongated and having an end portion insertable into a respective cavity;

d) a mechanical fastener for mounting between the connector node element and the framing member and capable of being fastened to maintain the connector node element and the framing member engaged with one another;

e) wherein the connector node element includes a channel for receiving therein an elongated load carrying chord;

f) wherein the mechanical fastener has a tool engaging head located for access by a tool through the channel such that when the elongated load carrying chord is received in the channel removal of the head to separate the framing member from the connector node element is precluded.

2. A moment transferring assembly as defined in claim 1, wherein the mechanical fastener includes a threaded shank.

3. A moment transferring assembly as defined in claim 2, wherein the framing member includes a threaded socket to receive the threaded shank, allowing the mechanical fastener to be fastened to maintain the connector node element and the framing member engaged with one another.

4. A moment transferring assembly as defined in claim 2, wherein the threaded shank is located centrally in the cavity.

5. A moment transferring assembly as defined in claim 1, wherein the framing member is an extrusion having an external wall, a central core and one or more openings between the central core and the external wall.

6. A moment transferring assembly as defined is claim 1, wherein the channel has a direction of longitudinal extent and allows mounting the elongated load carrying chord to the connector node element by inserting the elongated load carrying chord sideways into the channel along a direction that is generally transverse to the direction of longitudinal extent.

7. A moment transferring assembly as defined in claim 6, wherein the channel comprises a pair of walls opposite one another and the elongated load carrying chord comprises a pair of opposite wall portions such that when the elongated load carrying chord is received in the channel the walls face respective ones of the wall portions.

8. A moment transferring assembly as defined in claim 7, wherein the walls and the wall portions are flat.

9. A moment transferring assembly as defined is claim 1, wherein the connector node element includes a plurality of tubular components, each tubular component defining a respective one of the cavities.

10. A moment transferring assembly as defined in claim 1, wherein the connector node element is integrally formed.

11. A moment transferring assembly as defined in claim 10, wherein the connector node element is made from cast aluminum.

12. A moment transferring assembly as defined in claim 1, wherein the mechanical fastener extends parallel to a neutral axis of the framing member.

13. A moment transferring assembly as defined in claim 12, wherein the mechanical fastener extends generally along the neutral axis of the framing member.

14. A moment transferring assembly, comprising:

a) a connector node element having a plurality of cavities;

b) a plurality of framing members for mounting to the connector node element into respective ones of the cavities;

c) each framing member being generally elongated and having an end portion insertable into a respective cavity;

d) a mechanical fastener for mounting between the connector node element and the framing member and capable of being fastened to maintain the connector node element and the framing member engaged with one another;

e) wherein the connector node element includes a channel for receiving therein an elongated load carrying chord;

f) wherein the mechanical fastener has a tool engaging head and when the elongated load carrying chord is received in the channel the tool engaging head is adjacent the load carrying chord such that the mechanical fastener is precluded from backing out.

15. A moment transferring assembly as defined in claim 14, wherein the mechanical fastener includes a threaded shank.

16. A moment transferring assembly as defined in claim 15, wherein the framing member includes a threaded socket to receive the threaded shank, allowing the mechanical fastener to be fastened to maintain the connector node element and the framing member engaged with one another.

17. A moment transferring assembly as defined in claim 15, wherein the threaded shank is located centrally in the cavity.

18. A moment transferring assembly as defined in claim 14, wherein the framing member is an extrusion having an external wall, a central core and one or more openings between the central core and the external wall.

19. A moment transferring assembly as defined is claim 14, wherein the channel has a direction of longitudinal extent and allows mounting the elongated load carrying chord to the connector node element by inserting the elongated load carrying chord sideways into the channel along a direction that is generally transverse to the direction of longitudinal extent.

20. A moment transferring assembly as defined in claim 19, wherein the channel comprises a pair of walls generally parallel and opposite one another and the elongated load carrying chord comprises a pair of wall portions opposite one another such that when the elongated load carrying chord is received in the channel the walls face respective ones of the wall portions.

21. A moment transferring assembly as defined in claim 20, wherein the walls and the wall portions are flat.

22. A moment transferring assembly as defined is claim 14, wherein the connector node element includes a plurality of tubular components, each tubular component defining a respective one of the cavities.

23. A moment transferring assembly as defined in claim 14, wherein the connector node element is integrally formed.

24. A moment transferring assembly as defined in claim 23, wherein the connector node element is made from cast aluminum.

25. A moment transferring assembly as defined in claim 14, wherein the mechanical fastener extends parallel to a neutral axis of the framing member.

26. A moment transferring assembly as defined in claim 25, wherein the mechanical fastener extends generally along the neutral axis of the framing member.

27. A modular load bearing lattice structure, comprising:

a) a first chord;

b) a second chord;

c) a plurality of connector node elements mounted on the second chord, each connector node element comprising:

a channel receiving the second chord therein; and a plurality of cavities;

d) framing members linking the connector node elements to the first chord, wherein:

each framing member is generally elongated and has an end portion inserted in a respective one of the cavities of a respective one of the connector node elements;

a mechanical fastener is mounted between the framing member and the respective one of connector node elements and fastened to maintain the framing member and the respective one of the connector node elements engaged with one another; and the mechanical fastener has a tool engaging head located for access by a tool through the channel of the respective one of the connector node elements such that, with the second chord received in the channel if the respective one of the connector node elements, removal of the tool engaging head to separate the framing member from the respective one of the connector node elements is precluded.

28. A bridge comprising the modular load bearing lattice structure defined in claim 27.

29. A pedestrian walkway comprising the load bearing lattice structure defined in claim 27, wherein the first chord is a top chord of the pedestrian walkway and the second chord is a bottom chord of the pedestrian walkway, the framing members extending generally vertically between the top chord and the bottom chord.

30. A modular load bearing lattice structure, comprising:

a) a first chord;

b) a second chord;

c) a plurality of connector node elements mounted on the second chord, each connector node element comprising:

a channel receiving the second chord therein; and a plurality of cavities;

d) framing members linking the connector node elements to the first chord, wherein:

each framing member is generally elongated and has an end portion inserted in a respective one of the cavities of a respective one of the connector node elements;

a mechanical fastener is mounted between the framing member and the respective one of connector node elements and fastened to maintain the framing member and the respective one of the connector node elements engaged with one another; and the mechanical fastener has a tool engaging head and, with the elongated second chord received in the channel of the respective one of the connector node elements, the tool engaging head is adjacent the second chord such that the mechanical fastener is precluded from backing out.

31. A bridge comprising the modular load bearing lattice structure defined in claim 30.

32. A pedestrian walkway comprising the load bearing lattice structure defined in claim 30, wherein the first chord is a top chord of the pedestrian walkway and the second chord is a bottom chord of the pedestrian walkway, the framing members extending generally vertically between the top chord and the bottom chord.

* * * * *

UNITED STATES PATENT AND TRADEMARK OFFICE

CERTIFICATE OF CORRECTION

PATENT NO. : 7,882,586 B2
APPLICATION NO. : 12/495084
DATED : February 8, 2011
INVENTOR(S) : Alexandre de la Chevrotiere It is certified that error appears in the above-identified patent and that said Letters Patent is hereby corrected as shown below:

On the Title page:

Add: Related U.S. Application Data

Item (62) Division of application No. 11/383,030, filed on May 12, 2006, now Pat. No. 7,568,253.

Item (60) Provisional application No. 60/679,884, filed on May 12, 2005.

Signed and Sealed this
Tenth Day of July, 2012

David J. Kappos

David J. Kappos
*Director of the United States Patent and Trademark Office*